US006637356B2

(12) United States Patent
Beverly

(10) Patent No.: US 6,637,356 B2
(45) Date of Patent: Oct. 28, 2003

(54) NEEDLE MODULE FOR A TUFTING MACHINE

(75) Inventor: Ian Beverly, Blackburn (GB)

(73) Assignee: Spencer Wright Industries, Inc., Dalton, GA (US)

( * ) Notice: Subject to any disclaimer, the term of this patent is extended or adjusted under 35 U.S.C. 154(b) by 154 days.

(21) Appl. No.: 10/026,448

(22) Filed: Dec. 21, 2001

(65) Prior Publication Data

US 2002/0078870 A1 Jun. 27, 2002

Related U.S. Application Data

(63) Continuation-in-part of application No. 09/614,002, filed on Jul. 11, 2000, now Pat. No. 6,339,995.

(51) Int. Cl.[7] ..... D05C 3/02; D05C 15/10; D05B 85/02

(52) U.S. Cl. ..... 112/80.16; 112/222

(58) Field of Search ..... 112/80.16, 80.05, 112/80.4, 80.45, 222, 224, 225, 163

(56) References Cited

U.S. PATENT DOCUMENTS 6,339,995 B1 * 1/2002 Beverly ..... 112/80.16

* cited by examiner

*Primary Examiner*—Peter Nerbun
(74) *Attorney, Agent, or Firm*—Alan Ruderman; Stephen J. Stark

(57) ABSTRACT

A needle module contains a plurality of needles having a shank and an eye at a first end and a mounting portion at the second end mounted in a module body. A rod is mounted on and spaced apart from the module body transversely to the needles. Yarn stands pass over the rod and are directed through the eyes of the needles.

9 Claims, 3 Drawing Sheets

NEEDLE MODULE FOR A TUFTING MACHINE

This is a continuation-in-part of U.S. application Ser. No. 09/614,002 filed Jul. 11, 2000, U.S. Pat. No. 6,339,995.

BACKGROUND OF THE INVENTION

The present invention relates to a needle module for a tufting machine. A plurality of needles are mounted in the module each comprising a shank having an eye at one end, and a mounting portion at the opposite end mounted in the module and a yarn feed groove extending from the eye towards the mounting portion. Such modules are widely used in the art.

One problem with needles of this type is that, as the yarn is fed into the groove at an angle, friction between the yarn and the backing material causes an increase in yarn tension which causes problems such as stretching of the backing material, unevenness in the pile height, an increased power requirement to achieve needle penetration and an increase in loose fibers.

In an attempt to overcome these problems, a thread-feeding element has been proposed in EP-A-0882831. This thread-feeding element is essentially a guide which ensures that the yarn enters the top of the yarn feed groove and is then fed directly down the length of the needle thereby greatly reducing the contact between the yarn and backing material.

However, for various reasons, the only example which has proved practical is the double-eyed cranked needle shown in FIG. 4 of EP-A-0882831. Even with this design, there a number of disadvantages that have limited the applications of this needle. The complex structure of the needle makes it expensive to produce. The presence of the eye towards the upper end of the needle weakens the needle. The crank configuration limits the pitch (gauge) on in-line needle bars and modules. As the double-eyed configuration makes the needle difficult to thread, single staggered needle bars and modules are not practical. Thus, the needle has been used in only a limited number of applications.

A similar arrangement proposed by the applicant has a needle cranked such a way as to provide direct access to the top of the yarn feed groove. However, this also suffers from high manufacturing costs and reduced stability at the 90' bend and is not suitable for dual sliding needle bar machines due to threading difficulties.

A further attempt to overcome these problems is disclosed in our earlier application WO 01/77431 and U.S. Pat. No. 09/614,002 U.S. Pat. No. 6,339,995. This discloses a lateral rod extending through the top portion of the needles. This solution has proved successful under many circumstances, but can be difficult to implement in finer gauge machines.

SUMMARY OF THE INVENTION

According to the present invention, there is provided a needle module for a tufting machine having a body in which a plurality of needles are mounted, each needle comprising a shank having an eye at one end, a mounting portion at the opposite end which is mounted in the module body and a yarn feed groove extending from the eye towards the mounting portion; characterized by a rod mounted on and spaced from the module body and extending across the module body transversely to the needles.

By moving the transverse rod from the top of the needles to the needle module, a number of advantages arise. Firstly, the assembly is easier to manufacture as it is no longer necessary to make holes in the top of the needles which must then be aligned to receive the rod. Also, for any module, the yarn passing around the rod will then fan out so that it can reach particularly the outermost needles. By moving the rod higher up onto the needle module, the angle at which the yarn is fanned out is decreased, so that the yarn to the outermost needles of a module enters the yarn feed groove at a shallow angle and therefore flows more freely down the yarn feed groove. Also, when the rod is passed through the top of the needles, it is necessary for it to project from the end most needle in a module. This projecting part is required to abut the end most needle in an adjacent module to guide the yarn into that needle. In practice, difficulties arise with aligning this projecting part with the adjacent needle. With the present invention, as the yarns for a particular module pass around the rod without also having to pass between adjacent needles at this stage, all of the yarns for a particular module can be guided by the rod without it needing to project from the module. Any such alignment problems are therefore eliminated.

Preferably, the rod is mounted on a pair of bosses extending from opposite ends of a face of the housing. The rod can be fixed to the bosses, or may be formed as an integral part of the needle module body.

Preferably, the boss at the end of the module having a needle with an outwardly facing yarn feed groove has a face which faces the other boss, this face having a taper which tapers away from the other boss towards the needles. This provides a straighter path for the yarn into the yarn feed groove of the end needle.

BRIEF DESCRIPTION OF THE DRAWINGS

Examples of needles modules constructed in accordance with the present invention will now be described with reference to the accompanying drawings, in which.

DESCRIPTION OF THE PREFERRED EMBODIMENT

Figure 1A:
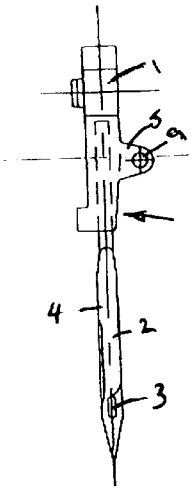
FIGS. 1A to 1C are an end view, front view and plan view respectively of a needle module.

In most respects, the structure of the tufting machine and the needle modules is entirely conventional and further details will not be provided here.

Each module 1 contains a plurality of needles 2. Each needle 2 has an eye 3 at its lowermost end and is mounted into the needle module 1 at its uppermost end. A yarn feed groove 4 extends from the eye 3 up the needle most of the way towards the module 1.

Figure 1B:
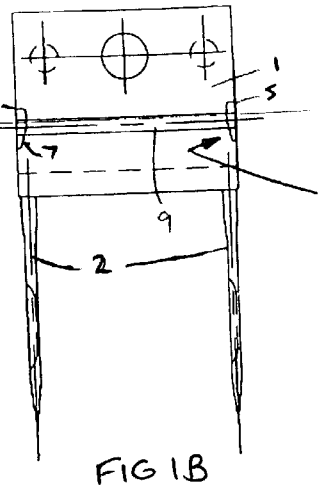
Figure 1C:
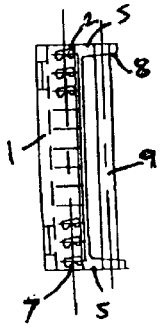

A pair of bosses 5 project from the face of the module 1 which, in use, faces in the direction from which the backing cloth 6 is fed. As shown in FIG. 1B, the inner faces of these bosses have a downward taper 7. As shown in FIG. 1C, the inner faces of the bosses 5 also have a taper 8 in a direction away from the module body 1.

Figure 2:
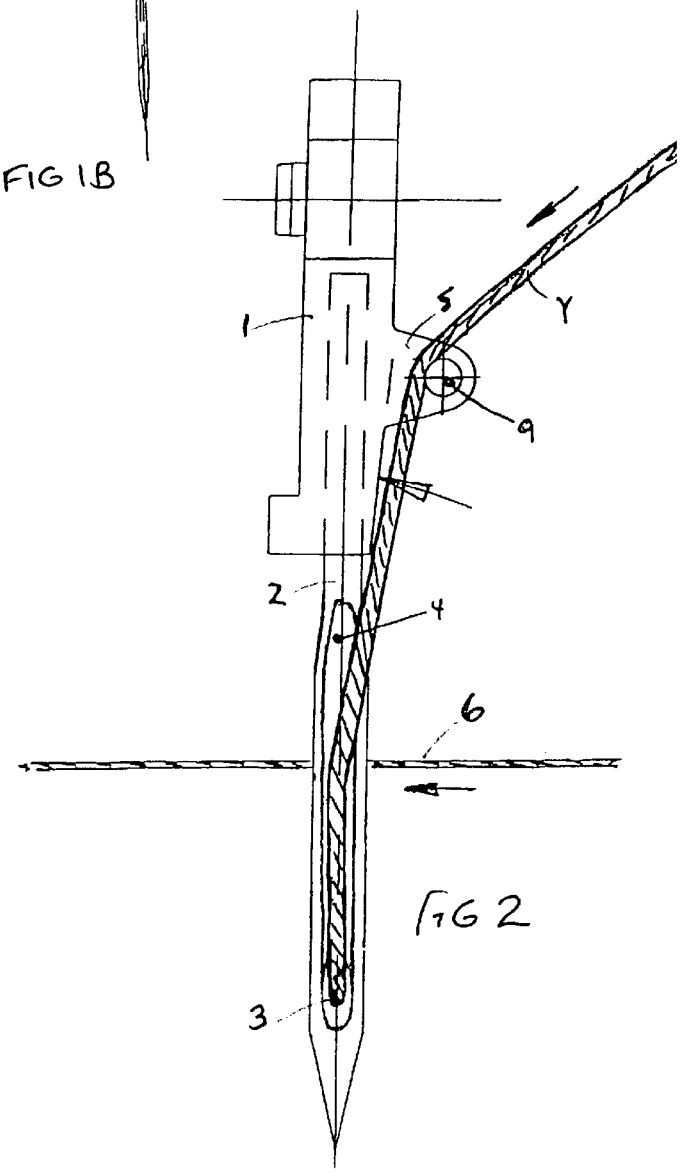
FIG. 2 is an enlarged version of FIG. 1A showing the passage of yarn through the module.

A steel rod 9 is fixed between the bosses 5 to provide a yarn guide as described with reference to FIG. 2.

The yarn Y is fed around the rod 9, and into the yarn feed groove 4. During needle penetration, the backing cloth 6 gently rolls the yarn into the yarn feed groove 4. The position of the rod 9 higher up on the needle module provides a relatively shallow angle of entry for the yarn Y into the yarn feed groove 4 at all stages during needle penetration. In FIG. 2, the needle is shown fully penetrated into the backing cloth 6.

Each module has a number of needles 2 and associated yarns Y. As will be appreciated from FIGS. 1B and 1C, the endmost needle which has its yarn feed groove 4 facing outwardly (this is the left hand needle in FIG. 1B and the lowermost needle in FIG. 1C) cannot have its yarn fed directly down from the rod 9 into the groove 4 as this is obstructed by the boss 5. Instead, the yarn for this needle is as close as possible to the boss 5, and then is then fanned slightly outwards into the groove 4. The angle at which this fanning occurs is reduced somewhat by the presence of the taper 7.

Figure 3A:
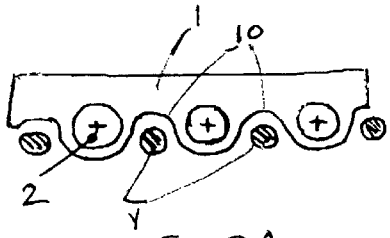
FIG. 3A is a schematic cross-section through line 3A in FIG. 3.
Figure 3:
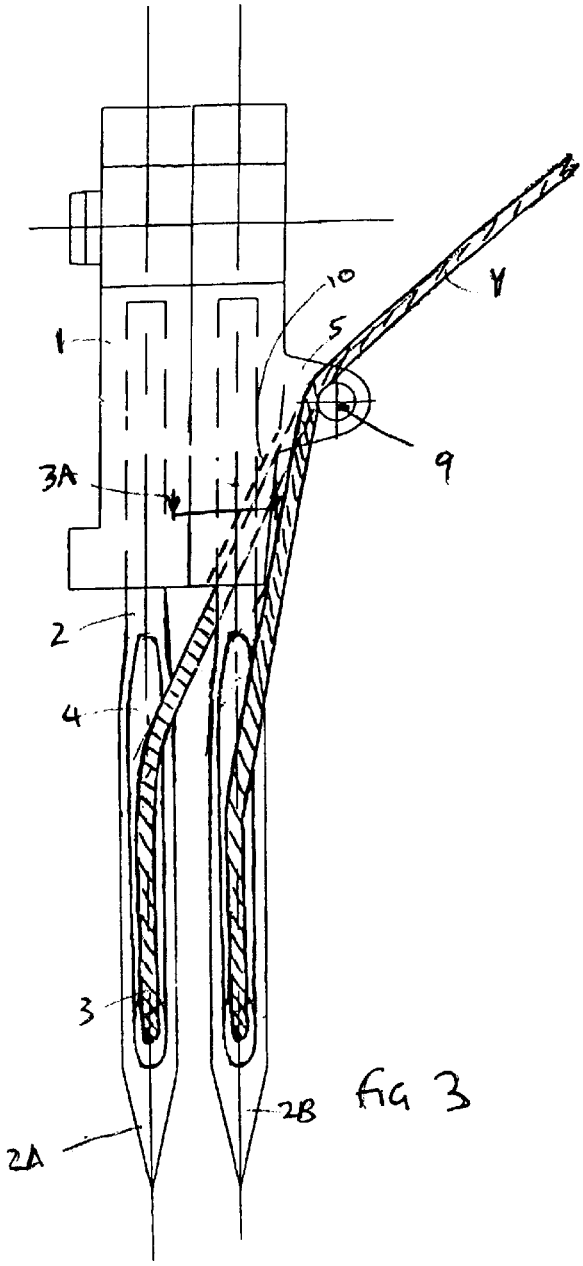
FIG. 3 is a view similar to FIG. 2 showing a staggered needle module.

An alternative needle module is shown in FIG. 3. This shows a staggered module having a rear set of needles 2A and a front set of needles 2B offset from one another by half a pitch. A single rod 9 is provided on the module to guide yarn to both sets of needles. A number of "scalloped," regions 10 are provided in the module 1 between adjacent needles as shown in FIG. 3A. These provide a path for the yarn Y fed to the rear set of needles 2A.

Figure 4:
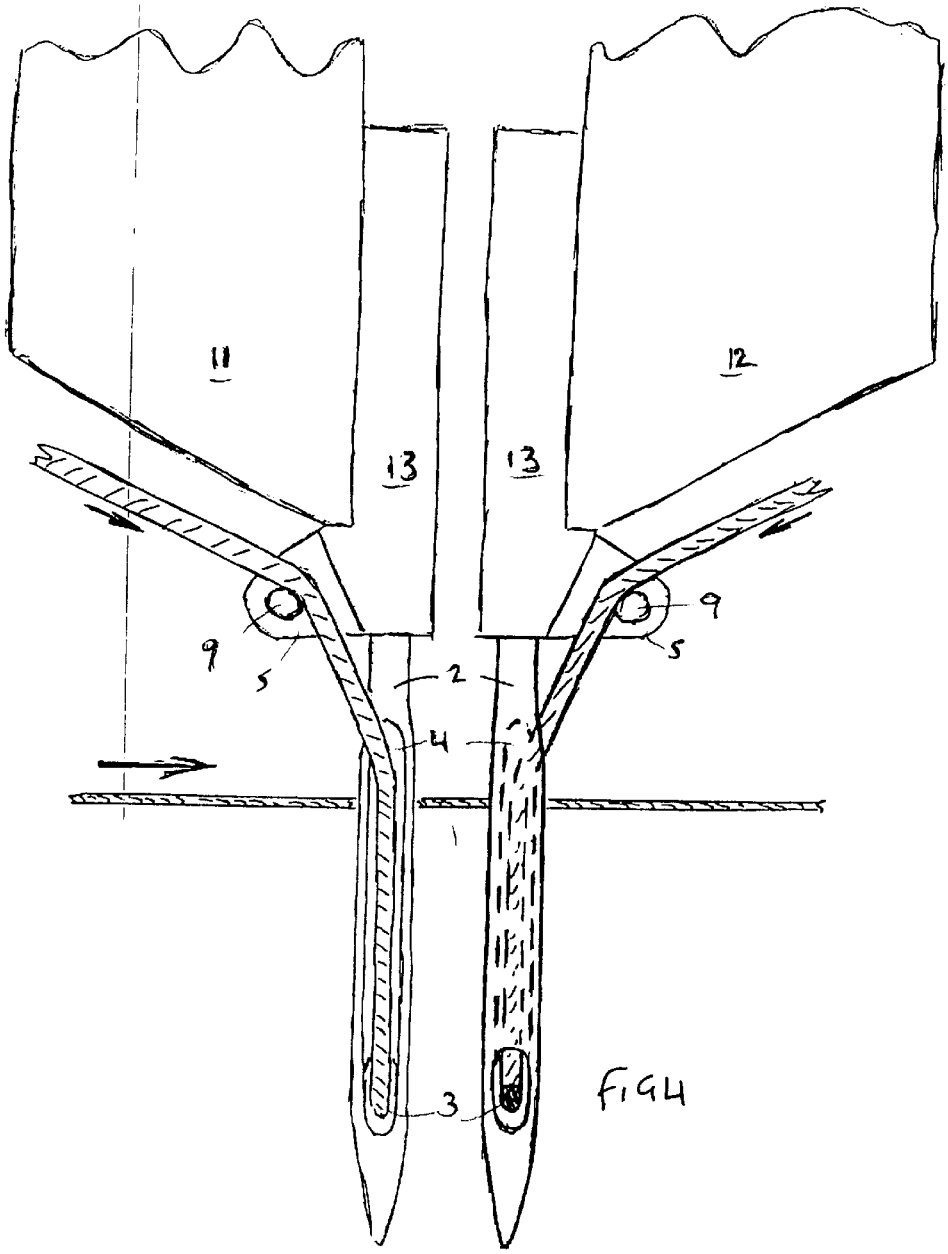
FIG. 4 is a view similar to FIG. 2 showing two modules on a dual sliding needle bar.

A dual sliding needle bar arrangement is shown in FIG. 4. This arrangement has a front sliding needle bar 11 and a rear sliding needle bar 12, each provided with a plurality of modules 13. These are similar to the modules 1, in that they have projecting bosses 5 between which a rod 9 is fixed. It will be noted, however, that the rods 9 are positioned lower on the needle module 13 than those illustrated in the previous drawings. As the dual needle bar is double the pitch of a single needle bar, fanning is less of a problem.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A needle module for a tufting machine having a body in which a plurality of needles are mounted, each needle comprising a shank having an eye at one end, a mounting portion at the opposite end which is mounted in the module body and a yarn feed groove extending from the eye towards the mounting portion; characterized by a rod mounted on and spaced from the module body and extending across the needle body transversely to the needles.

2. A needle module according to claim 1, wherein the rod is mounted on a pair of bosses extending from opposite ends of a face of a housing.

3. A needle module according to claim 1, wherein a boss at an end of the module having a needle with an outwardly facing yarn feed groove having a face which faces another boss, this face having a taper which tapers away from the other boss towards the needles.

4. A needle module according to claim 2, wherein the rod is fixed to the bosses.

5. A needle module according to claim 3, wherein the rod is fixed to the bosses.

6. A needle module according to claim 2, wherein the rod is formed as an integral part of the needle module body.

7. A needle module according to claim 3, wherein the rod is formed as an integral part of the needle module body.

8. A needle module according to claim 4, wherein the rod is formed as an integral part of the needle module body.

9. A needle module according to claim 5, wherein the rod is formed as an integral part of the needle module body.

* * * * *